US007224122B2

(12) United States Patent
Yoo

(10) Patent No.: US 7,224,122 B2
(45) Date of Patent: May 29, 2007

(54) PLASMA DISPLAY PANEL (PDP) WITH MULTIPLE DIELECTRIC LAYERS

(75) Inventor: Sung-Hune Yoo, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 166 days.

(21) Appl. No.: 10/969,908

(22) Filed: Oct. 22, 2004

(65) Prior Publication Data

US 2005/0088096 A1 Apr. 28, 2005

(30) Foreign Application Priority Data

Oct. 28, 2003 (KR) ..... 10-2003-0075572

(51) Int. Cl.
*H01J 17/49* (2006.01)

(52) U.S. Cl. ..... 313/586; 313/587; 313/582

(58) Field of Classification Search ..... 313/582, 313/586–587

See application file for complete search history.

(56) References Cited

U.S. PATENT DOCUMENTS

| | | | | |
|---|---|---|---|---|
| 5,922,453 | A * | 7/1999 | Horn et al. | 428/325 |
| 6,160,345 | A * | 12/2000 | Tanaka et al. | 313/587 |
| 6,255,780 | B1 * | 7/2001 | Komaki et al. | 313/586 |
| 6,419,540 | B1 * | 7/2002 | Tanaka et al. | 445/24 |
| 6,888,310 | B2 * | 5/2005 | Tadaki et al. | 313/587 |
| 2005/0140579 | A1 * | 6/2005 | Yoo | 345/60 |
| 2005/0228115 | A1 * | 10/2005 | Auguste et al. | 524/505 |

FOREIGN PATENT DOCUMENTS

| | | |
|---|---|---|
| JP | 02-148645 | 6/1990 |
| JP | 10-074455 | 3/1998 |
| JP | 2845183 | 10/1998 |
| JP | 11-060272 | 3/1999 |
| JP | 2917279 | 4/1999 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Sikha Roy
*Assistant Examiner*—Natalie K. Walford
(74) *Attorney, Agent, or Firm*—Robert E. Bushnell, Esq.

(57) ABSTRACT

A Plasma Display Panel (PDP) includes: a front panel including a front substrate including a plurality of sustain electrodes and a plurality of scanning electrodes arranged thereon; and a rear panel including a back substrate including a plurality of address electrodes intersecting the plurality of sustain electrodes and scanning electrodes and including a dielectric layer arranged on the back substrate to cover the plurality of address electrodes; wherein the dielectric layer includes a first dielectric layer disposed on the back substrate to cover the address electrodes and a second dielectric layer disposed on the first dielectric layer and having a dielectric constant less than that of the first dielectric layer.

17 Claims, 3 Drawing Sheets

FOREIGN PATENT DOCUMENTS

| | | | |
|---|---|---|---|
| JP | 11-167871 | | 6/1999 |
| JP | 11195375 A | * | 7/1999 |
| JP | 2000-011885 | | 1/2000 |
| JP | 2001-043804 | | 2/2001 |
| JP | 2001-325888 | | 11/2001 |

OTHER PUBLICATIONS

Korean Office Action of the Korean Patent Application No. 2003-75572, issued on Mar. 24, 2006.

* cited by examiner

PLASMA DISPLAY PANEL (PDP) WITH MULTIPLE DIELECTRIC LAYERS

CLAIM OF PRIORITY

This application makes reference to, incorporates the same herein, and claims all benefits accruing under 35 U.S.C. section 119 from an application for PLASMA DISPLAY PANEL WITH MULTI DIELECTRIC LAYER ON REAR GLASS PLATE earlier filed in the Korean Intellectual Property Office on 28 Oct. 2003 and there duly assigned Serial No. 2003-75572.

BACKGROUND OF THE INVENTION

1. Field of the Invention

The present invention relates to a Plasma Display Panel (PDP), and more particularly, to a PDP with multiple dielectric layers on a rear glass plate.

2. Description of the Related Art

A PDP, which is a device for displaying characters or graphics using light emitted from a plasma during a gas discharge, is an emissive flat display panel utilizing a gas discharge.

PDPs are categorized into a Direct Current (DC) PDP and an Alternating Current (AC) PDP according to the method of applying a drive voltage to the discharge cells. A DC PDP has electrodes directly exposed to a plasma and the discharge current directly flows through the electrodes, requiring separate external resistance for limiting the current. On the other hand, an AC PDP has electrodes covered by a dielectric layer, that is, the electrodes are not directly exposed to a plasma, thereby protecting the electrodes from ionic impact during discharge. Also, the AC PDP is advantageous in that a displacement current flows through the electrodes. The AC PDP can be classified according to the electrode structure of a discharge cell into an opposite discharge PDP, a surface discharge PDP, and a partition discharge PDP. In particular, the surface discharge PDP is advantageous in that electrode portions where a discharge occurs are arranged on one substrate and phosphor layers are arranged on the other substrate so that deterioration of the phosphor layers due to ion bombardment during a discharge is suppressed.

An AC surface discharge PDP includes a front substrate and a back substrate. The front substrate has a plurality of sustain electrodes and a plurality of scanning electrodes arranged thereon, and a bus electrode is disposed on each of the plurality of sustain electrodes and the plurality of scanning electrodes. A front dielectric layer is formed to cover the electrodes arranged on the front substrate, and a protective layer formed of MgO is formed to cover the front dielectric layer. The back substrate has a plurality of address electrodes arranged thereon. The plurality of sustain electrodes and scanning electrodes arranged on the front substrate, and the plurality of address electrode arranged on the back substrate, intersect, i.e., they are orthogonal to each other, the front substrate and the back substrate being parallel to each other. A back dielectric layer is formed on the back substrate to cover the plurality of address electrodes. A plurality of partitions are arranged on the back dielectric layer and red, green and blue phosphors are coated between each of the plurality of partitions.

The AC surface discharge PDP is driven using charges on the dielectric layer covering the electrodes, that is, wall charges. An address discharge is caused at a discharge space formed between each of the plurality of sustain electrodes and scanning electrodes arranged on the front substrate and each of the plurality of address electrodes arranged on the back substrate so as to be opposite to and face the sustain electrodes and scanning electrodes, thereby achieving a surface discharge. AC surface discharge PDPs that are currently being produced have a luminance of approximately 350cd/$m^2$ and an output efficiency of approximately lm/W. Theoretically, a high luminance of greater than 500 cd/$m^2$ and a high output efficiency of greater than 4 lm/W can be achieved by a gas discharge performed by a PDP. In reality, however, a peak luminance of a Cathode Ray Tube (CRT) is approximately 700 cd/$m^2$ and the efficiency thereof is not greater than several lm/W. Thus, it is necessary to further improve a luminance and efficiency of a PDP.

Various techniques for producing PDPs having improved luminance have been proposed. Particularly, a technique of increasing reflectivity has been used. In other words, when a gas discharge occurs at a discharge cell of a PDP, visible light is generated so that phosphors are excited to emit the visible light. In order to cause as much as visible light to travel toward a front portion of the PDP, it is necessary to increase reflectivity. One way to increase reflectivity is by adding an additive, that is, a white pigment of a metal oxide, to a back dielectric layer, the white pigment being at least one selected from the group consisting of alumina ($Al_2O_3$), titanium oxide ($TiO_2$), yttrium oxide ($Y_2O_3$), magnesium oxide (MgO), calcium oxide (CaO), tantalum oxide ($Ta_2O_5$), silicon oxide ($SiO_2$), and barium oxide (BaO). This technique is disclosed in Japanese Laid-Open Patent Publication No. 1999-60272, and Japanese Patent Laid-Open Patent Publication No. 1998-74455.

Such attempts for increasing reflectivity by adding an additive to a back dielectric layer, however, still have limitations. That is, as the amount of the white pigment added to the back dielectric layer increases, the reflectivity of the back dielectric layer increases but results in a deterioration in the conductivity of the dielectric layer due to an increase in the dielectric constant of the dielectric layer. Thus, a withstanding voltage of the dielectric layer is reduced, ultimately leading to a breakdown when a discharge occurs at a discharge cell of the PDP.

Another way of increasing the reflectivity is forming a reflective layer on surfaces of partitions and the dielectric layer, as disclosed in Japanese Laid-Open Patent Publication No. 2000-11885. According to this technique, separately from the dielectric layer, a $TiO_2$ layer is formed on the surface of the dielectric layer and the surface of the partitions. However, a withstanding voltage between cells is lowered, causing a breakdown during a discharge. Thus, in order to ensure an electrical insulating property, it is necessary to remove a reflective layer made of metal oxide formed on the partitions, which makes the process complicated, increasing the production cost of the PDP.

SUMMARY OF THE INVENTION

The present invention provides a PDP having an increased luminous efficiency.

The present invention also provides a PDP having a dielectric layer with an improved withstanding voltage while increasing a luminous efficiency.

The present invention also provides a PDP including a dual back dielectric layer having $TiO_2$ of different phases added thereto to prevent a breakdown during plasma discharge.

According to one aspect of the present invention, a PDP is provided comprising: a front panel including a front substrate including a plurality of sustain electrodes and a plurality of scanning electrodes arranged thereon; and a rear panel including a back substrate including a plurality of address electrodes intersecting the plurality of sustain electrodes and scanning electrodes and including a dielectric layer arranged on the back substrate to cover the plurality of address electrodes; wherein the dielectric layer includes a first dielectric layer disposed on the back substrate to cover the address electrodes and a second dielectric layer disposed on the first dielectric layer and having a dielectric constant less than that of the first dielectric layer.

The first dielectric layer and the second dielectric layer each preferably includes only a base material.

The first dielectric layer preferably includes a base material and a first additive having a specific dielectric constant greater than that of the base material.

The first additive preferably comprises a white pigment.

The white pigment is preferably one selected from the group consisting of alumina ($Al_2O_3$), titanium oxide ($TiO_2$), yttrium oxide ($Y_2O_3$), magnesium oxide (MgO), calcium oxide (CaO), tantalum oxide ($Ta_2O_5$), silicon oxide ($SiO_2$), and barium oxide (BaO).

The first dielectric layer and the second dielectric layer each preferably includes at least one additives.

The at least one additive preferably comprises a white pigment.

The white pigment is preferably one selected from the group consisting of alumina ($Al_2O_3$), titanium oxide ($TiO_2$), yttrium oxide ($Y_2O_3$), magnesium oxide (MgO), calcium oxide (CaO), tantalum oxide ($Ta_2O_5$), silicon oxide ($SiO_2$), and barium oxide (BaO).

A specific dielectric constant of the at least one additive included in the first dielectric layer is preferably greater than that of the at least one additive included in the second dielectric layer.

A specific dielectric constant of the at least one additive included in the first dielectric layer is preferably substantially the same as that of the at least one additive included in the second dielectric layer, and wherein an amount of the at least one additive included in the first dielectric layer is greater than that of the at least one additive included in the second dielectric layer.

According to another aspect of the present invention, a PDP is provided comprising: a front panel including a front substrate including a plurality of sustain electrodes and a plurality of scanning electrodes arranged thereon; and a rear panel including a back substrate including a plurality of address electrode intersecting the plurality of sustain electrodes and scanning electrodes and including a dielectric layer formed on the back substrate to cover the plurality of address electrodes; wherein the dielectric layer includes a first dielectric layer disposed on the back substrate to cover the address electrodes, and a second dielectric layer disposed on the first dielectric layer and having a dielectric constant less than that of the first dielectric layer; wherein the first and second dielectric layers each includes an additive; and wherein the additive is at least one selected from the group consisting of anatase-phase titanium oxide and rutile-phase titanium oxide.

The additive included in the second dielectric layer preferably comprises anatase-phase titanium oxide.

The additive included in the first dielectric layer preferably comprises rutile-phase titanium oxide.

According to still another aspect of the present invention, a PDP is provided comprising: a front panel; and a rear panel; wherein the rear panel includes at least two dielectric layers, one of the at least two dielectric layers facing the front panel having a lower dielectric constant than that of another of the at least two dielectric layers.

Each of the at least two dielectric layers preferably comprises a sheet incorporated therein.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will now be described in more detail with reference to the appended drawings.

Figure 1:
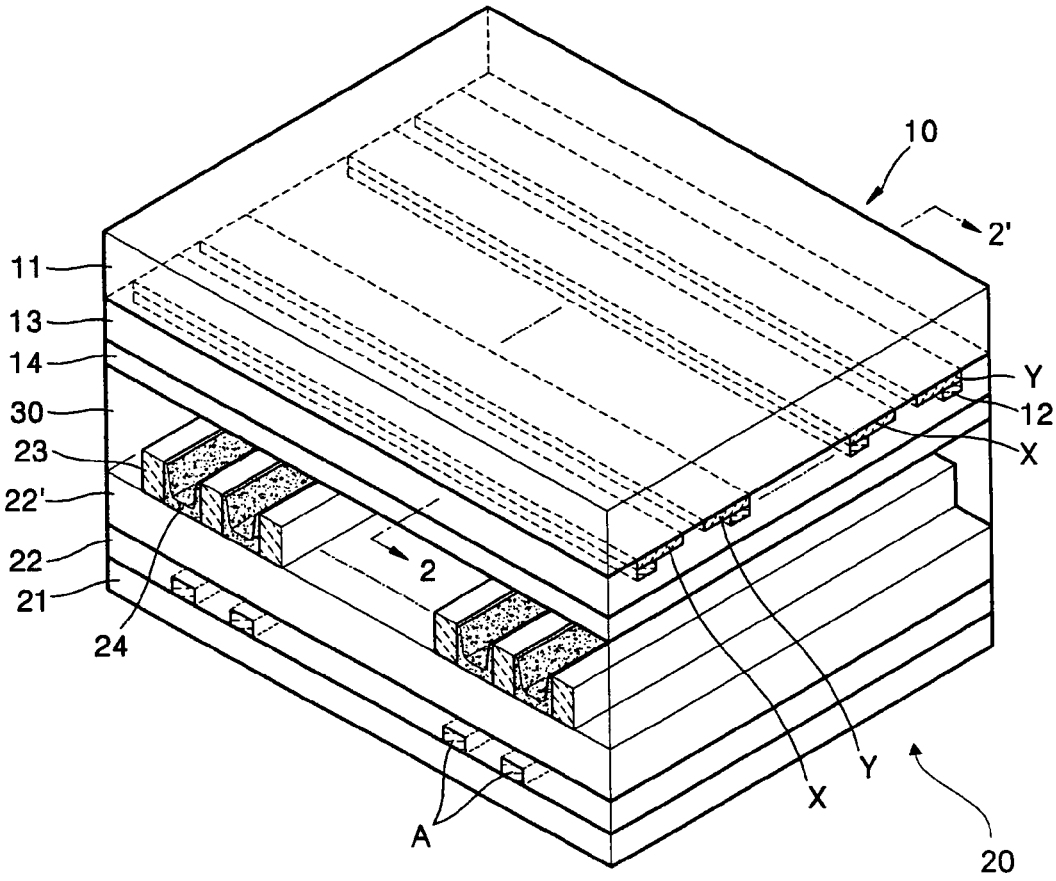
FIG. 1 is a perspective view of a PDP according to an embodiment of the present invention.
Figure 2:
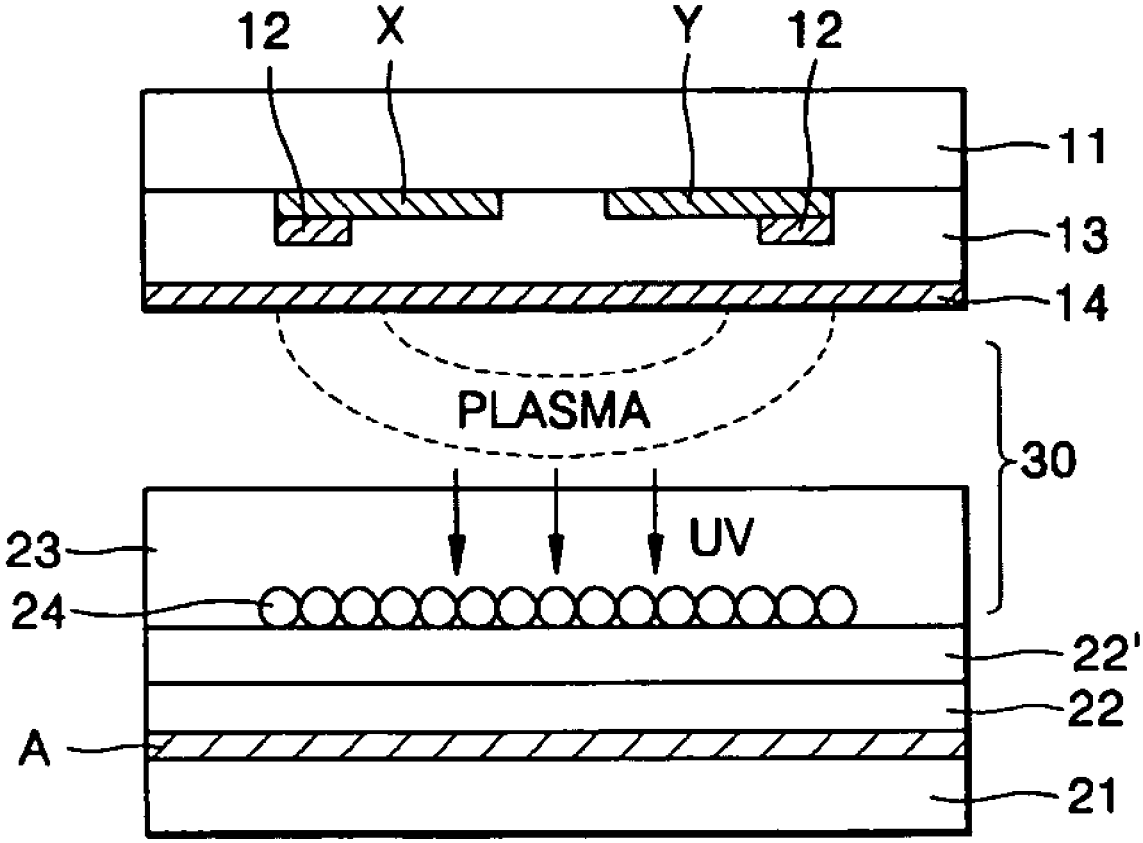
FIG. 2 is a cross-sectional view of the PDP taken along the line 2—2 of FIG. 1.

FIG. 1 is a perspective view of a PDP having dual back dielectric layers according to an embodiment of the present invention, and FIG. 2 is a cross-sectional view of the PDP taken along the line 2—2 of FIG. 1.

The PDP according to the present invention includes a front panel 10, a rear panel 20, and a plurality of discharge spaces 30. A plurality of sustain electrodes and scanning electrodes X and Y are arranged on one plane of a front substrate 11 of the front panel 10. Referring to FIG. 2, the sustain electrodes and the scanning electrodes have the same structures but have different voltage pulses supplied thereto. Bus electrodes 12 are arranged on and contact one plane of each of the plurality of sustain electrodes and scanning electrodes X and Y having a high transmissivity. The bus electrodes 12 have a low resistance and a uniform line width. A front dielectric layer 13 is formed on the front substrate 11 to cover the plurality of electrodes arranged on the front substrate 11. The dielectric layer 13 protects the plurality of sustain electrodes and scanning electrodes X and Y and the bus electrodes 12 and serves as an electrical capacitor between the discharge spaces 30 and the electrodes. In order to prevent the dielectric layer 13 from being damaged due to ion bombardment generated when discharges occur at the discharge cells of the PDP, a protective layer 14 is formed on one plane of the dielectric layer 13. Preferably, the protective layer 14 is made of MgO.

A plurality of address electrodes A are arranged on one plane of the back substrate 21 of the rear panel 20. When viewed in a direction from the front panel 10 to the rear panel 20, the plurality of address electrodes A are arranged so as to intersect, i.e., to be orthogonal to, the plurality of sustain electrodes and scanning electrodes X and Y arranged on the front substrate 11. Back dielectric layers 22 and 22' are formed on the back substrate 21 to cover the plurality of address electrodes A. Partitions 23 are formed on a plane directly facing the front panel 10 of the back dielectric layers 22 and 22'. The partitions 23 are formed by various methods, i.e., a high density printing method, an additive method, a sand blasting method, a photolithography method and the like. Red, green and blue phosphors 24 are coated between each of the partitions 23. In particular, the back dielectric layer which directly faces the front panel 10 preferably has a lower dielectric constant than that of the other dielectric layer.

In the PDP according to the present invention, the back dielectric layer 22' which directly faces the front panel 10 has a reduced dielectric constant as compared to the back dielectric layer 22.

As shown in FIG. 1, the back dielectric layers 22 and 22' are formed of preforms of a low melting point glass material. Examples of the low melting point glass material include lead oxide (PbO), silicon oxide ($SiO_2$), boron oxide ($B_2O_3$), and zinc oxide ($ZnO_3$). Another way to reduce the dielectric constant of a dielectric layer is to add an additive to at least one of the multiple dielectric layers, which directly faces the front panel 10. Examples of a usable additive include alumina ($Al_2O_3$), titanium oxide ($TiO_2$), yttrium oxide ($Y_2O_3$), magnesium oxide (MgO), calcium oxide (CaO), tantalum oxide ($Ta_2O_5$), silicon oxide ($SiO_2$), and barium oxide (BaO). The additive can be optionally included in one back dielectric layer or can be included in all back dielectric layers. The dielectric constants of the back dielectric layers can be adjusted by adjusting the specific dielectric constants or the contents of the additive(s) used. For example, additives having different specific dielectric constants can be used. Otherwise, when the same additive is used, the dielectric constants of the back dielectric layers can be adjusted by varying the contents of the additives contained in the back dielectric layers. As described above, the dielectric constants of the back dielectric layers can be adjusted by adjusting the specific dielectric constants of the low melting point glass material and the additive(s) and the contents of the low melting point glass material and the additive(s). In such a manner, the dielectric constant of the back dielectric layer 22' which directly faces the front panel 10 can be adjusted to be relatively lower than that of the other back dielectric layer 22.

Although, in the above embodiment, the back dielectric layers are composed of two layers, that is, the back dielectric layers 22 and 22', the back dielectric layers can, of course, have two or more layers having different dielectric constants.

Figure 3:
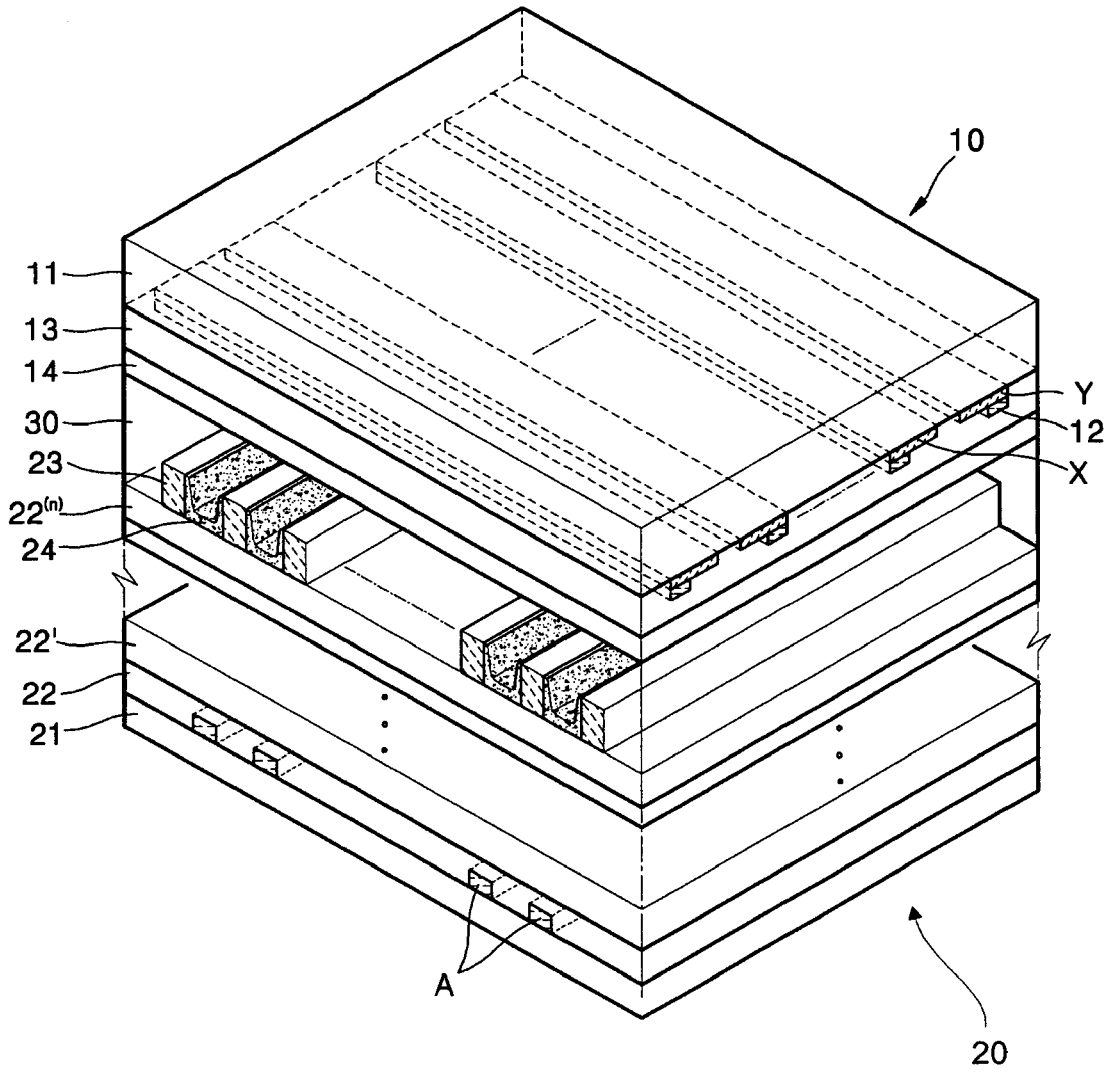
FIG. 3 is a perspective view of a PDP according to another embodiment of the present invention.

Thus, the above-described technique for reducing the dielectric constant of a back dielectric layer directly facing the front panel 10 of the PDP is also applicable to a PDP having more than two back dielectric layers, as shown in FIG. 3. In this case, a back dielectric layer directly facing the front panel 10 is defined by reference numeral $\mathbf{22}^{(n)}$.

Specifically, in the PDP according to the illustrative embodiment, the back dielectric layer can be embodied as dual back dielectric layers, and additives having different crystal phases, e.g., titanium oxide, can be added to the back dielectric layers. For example, titanium oxide added as a white pigment generally has brookite, rutile and anatase phases, typically rutile and anatase phases. Table 1 summarizes physical properties of anatase-phase titanium oxide and rutile-phase titanium oxide used in the illustrative embodiment. Anatase-phase titanium oxide is automatically converted into rutile-phase titanium oxide at a high temperature of about 915° C. Although the anatase is substantially the same as the rutile in view of gloss, hardness and density, anatase-phase titanium oxide and rutile-phase titanium demonstrate differences in crystal structure and split state. Also, as listed in Table 1, the specific dielectric constant of rutile-phase is 3 to 4 times greater than that of anatase-phase titanium oxide specific dielectric constant.

TABLE 1

| | Anatase phase | Rutile phase |
|---|---|---|
| Grain boundary | Tetragonal system | Tetragonal system |
| Specific weight | 3.9 | 4.2 |
| Refractive index | 2.52 | 2.71 |
| Hardness | 5.5~6.0 | 6.0~7.0 |
| Specific dielectric constant | 31 | 114 |
| Melting point | Convertible into rutile phase at high temperature | 1858° C. |

Titanium oxide is used as an additive of the respective back dielectric layers, and the back dielectric layer 22' directly facing the front panel 10 is formed of an anatase-phase titanium oxide while the back dielectric layer 22 close to the rear panel 20 is formed of a rutile-phase titanium oxide, to ensure a stable withstanding voltage and high reflectivity, thereby reducing the possibility of a breakdown and increasing the luminous efficiency.

While a rear panel having dual dielectric layers has been particularly illustrated and described, the present invention is not limited thereto and various modifications can be made to provide dielectric layers having an increased luminous efficiency and a high withstanding voltage. As described above, the dielectric layers disposed over the address electrodes of the rear panel can be formed of multiple dielectric layers having different dielectric constants such that the dielectric constants of the dielectric layers get lower as the dielectric layers are closer to the front panel.

The dielectric layers disposed on the rear panel can be formed of independent sheets. In other words, the PDP according to the present invention includes one or more layers having different dielectric constants, which can be easily formed by attaching a single independent dielectric layer sheet.

While the present invention has been particularly shown and described with reference to exemplary embodiments thereof, it will be understood by those of ordinary skill in the art that various modifications in form and details can be made therein without departing from the spirit and scope of the present invention as recited by the following Claims.

What is claimed is:

1. A Plasma Display Panel (PDP), comprising:

a front panel including a front substrate including a plurality of sustain electrodes and a plurality of scanning electrodes arranged thereon; and a rear panel including a back substrate including a plurality of address electrodes intersecting the plurality of sustain electrodes and scanning electrodes and including a dielectric layer arranged on the back substrate to cover the plurality of address electrodes;

wherein the dielectric layer includes a first dielectric layer disposed on the back substrate to cover the address electrodes and a second dielectric layer disposed on the first dielectric layer and having a dielectric constant less than that of the first dielectric layer, the first dielectric layer including a base material and a first additive having a dielectric constant greater than a dielectric constant of the base material to increase the dielectric constant of the first dielectric layer.

2. The PDP of claim 1, wherein the second dielectric layer includes only a base material.

3. The PDP of claim 1, wherein the first additive comprises a white pigment.

4. The PDP of claim 3, wherein the white pigment is one selected from the group consisting of alumina ($Al_2O_3$), titanium oxide ($TiO_2$), yttrium oxide ($Y_2O_3$), magnesium oxide (MgO), calcium oxide (CaO), tantalum oxide ($Ta_2O_5$), silicon oxide (SiO2), and barium oxide (BaO).

5. The PDP of claim 1, wherein the first dielectric layer and the second dielectric layer each includes at least one additive.

6. The PDP of claim 5, wherein the at least one additive comprises a white pigment.

7. The PDP of claim 6, wherein the white pigment is one selected from the group consisting ofalumina($Al_2O_3$3), titanium oxide($TiO_2$), yttrium oxide ($Y_2O_3$), magnesium oxide (MgO), calcium oxide (CaO), tantalum oxide($Ta_2O_5$), silicon oxide($SiO_2$), and barium oxide(BaO).

8. The PDP of claim 5, wherein a specific dielectric constant of the at least one additive included in the first dielectric layer is greater than that of the at least one additive included in the second dielectric layer.

9. The PDP of claim 6, wherein a specific dielectric constant of the at least one additive included in the first dielectric layer is greater than that of the at least one additive included in the second dielectric layer.

10. The PDP of claim 7, wherein a specific dielectric constant of the at least one additive included in the first dielectric layer is greater than that of the at least one additive included in the second dielectric layer.

11. The PDP of claim 5, wherein a specific dielectric constant of the at least one additive included in the first dielectric layer is substantially the same as that of the at least one additive included in the second dielectric layer, and wherein an amount of the at least one additive included in the first dielectric layer is greater than that of the at least one additive included in the second dielectric layer.

12. A Plasma Display Panel (PDP), comprising:

a front panel including a front substrate including a plurality of sustain electrodes and a plurality of scanning electrodes arranged thereon; and a rear panel including a back substrate including a plurality of address electrodes intersecting the plurality of sustain electrodes and scanning electrodes and including a dielectric layer formed on the back substrate to cover the plurality of address electrodes;

wherein the dielectric layer includes a first dielectric layer disposed on the back substrate to cover the address electrodes, and a second dielectric layer disposed on the first dielectric layer and having a dielectric constant less than that of the first dielectric layer;

wherein the first and second dielectric layers each includes an additive;

wherein the additive is at least one selected from the group consisting of anatase-phase titanium oxide and rutile-phase titanium oxide.

13. The PDP of claim 12, wherein the additive included in the second dielectric. layer comprises anatase-phase titanium oxide.

14. The PDP of claim 12, wherein the additive included in the first dielectric layer comprises rutile-phase titanium oxide.

15. The PDP of claim 13, wherein the additive included in the first dielectric layer comprises rutile-phase titanium oxide.

16. A Plasma Display Panel (PDP), comprising:

a front panel;

a rear panel;

wherein the rear panel includes at least three dielectric layers, one of the at least three dielectric layers facing the front panel having a lower dielectric constant than that of another of the at least three dielectric layers.

17. The PDP of claim 16, wherein each of the at least three dielectric layers comprises a sheet incorporated therein.

* * * * *